US011149731B2

(12) United States Patent
Asaoka

(10) Patent No.: US 11,149,731 B2
(45) Date of Patent: Oct. 19, 2021

(54) PUMP APPARATUS HAVING AXIALLY MOVING SHAFT BEARING DISPOSED ADJACENT A PRESSURE RELIEF PASSAGE TO FACILITATE A PRESSURE RELIEF FUNCTION OF SAME

(71) Applicant: JTEKT CORPORATION, Osaka (JP)

(72) Inventor: Yuuki Asaoka, Kariya (JP)

(73) Assignee: JTEKT CORPORATION, Osaka (JP)

( * ) Notice: Subject to any disclaimer, the term of this patent is extended or adjusted under 35 U.S.C. 154(b) by 209 days.

(21) Appl. No.: 16/232,198

(22) Filed: Dec. 26, 2018

(65) Prior Publication Data

US 2019/0195223 A1 Jun. 27, 2019

(30) Foreign Application Priority Data

Dec. 27, 2017 (JP) ..... JP2017-250286

(51) Int. Cl.
*F04C 15/06* (2006.01)
*F04C 2/344* (2006.01)
(Continued)

(52) U.S. Cl.
CPC ..... *F04C 15/06* (2013.01); *F04C 2/344* (2013.01); *F04C 2/3446* (2013.01); *F04C 14/24* (2013.01);
(Continued)

(58) Field of Classification Search
CPC ..... F04C 15/06; F04C 14/24; F04C 15/064; F04C 14/26; F04C 2/3446; F04C 2/344;
(Continued)

(56) References Cited

U.S. PATENT DOCUMENTS 2,444,165 A 6/1948 Lauck
2,472,031 A 5/1949 Wichorek
(Continued)

FOREIGN PATENT DOCUMENTS

JP 2016-50505 4/2016

OTHER PUBLICATIONS

Extended European Search Report dated Mar. 26, 2019 in Patent Application No. 18215089.6, 5 pages.

*Primary Examiner* — Mary Davis
*Assistant Examiner* — Paul W Thiede
(74) *Attorney, Agent, or Firm* — Oblon, McClelland, Maier & Neustadt, L.L.P.

(57) ABSTRACT

A pump apparatus includes a housing, a shaft, a rotor, a plurality of vanes, a pressure relief passage, and a bearing. The housing includes suction ports and discharge ports. The rotor and the vanes transport hydraulic oil to the discharge ports. The hydraulic oil is sucked from the suction ports. The pressure relief passage is defined in a portion of the housing facing an outer peripheral surface of the shaft. The pressure relief passage brings the discharge ports into communication with a low pressure region where the hydraulic oil is low in pressure. When a pressure of the hydraulic oil in the discharge ports is lower than a first predetermined pressure, the bearing keeps the pressure relief passage out of communication with a passage. When the pressure of the hydraulic oil in the discharge ports has increased to reach or exceed the first predetermined pressure, the bearing brings the pressure relief passage into communication with the passage.

11 Claims, 8 Drawing Sheets

(51) Int. Cl.
*F04C 14/24* (2006.01)
*F04C 14/26* (2006.01)

(52) U.S. Cl.
CPC ..... *F04C 14/26* (2013.01); *F04C 15/064* (2013.01); *F04C 2240/50* (2013.01); *F04C 2270/185* (2013.01)

(58) Field of Classification Search
CPC ..... F04C 2240/50; F04C 2270/185; F04C 13/001; F04C 14/00; F04C 15/00; F04C 15/0003; F04C 15/0023; F04C 15/0026; F04C 15/0038; F04C 27/004; F04C 27/005; F04C 27/009; F04C 2210/206; F01C 21/008; F01C 19/08; F01C 19/125; F01C 2021/16
USPC ..... 418/13, 15, 30, 31, 35, 77, 79, 80, 178, 418/179, 181, 191, 227, 233, 248, 258, 418/259, 263, 270
See application file for complete search history.

(56) References Cited

U.S. PATENT DOCUMENTS

| | | | | |
|---|---|---|---|---|
| 2,949,081 | A | 8/1960 | Deschamps | |
| 3,269,327 | A * | 8/1966 | Norlin | F04C 15/0026 418/135 |
| 2009/0047141 | A1* | 2/2009 | Yamamuro | F04C 14/226 417/218 |
| 2012/0251371 | A1* | 10/2012 | Nirasawa | F04C 2/102 418/166 |
| 2017/0227007 | A1 | 8/2017 | Akatsuka et al. | |

* cited by examiner

PUMP APPARATUS HAVING AXIALLY MOVING SHAFT BEARING DISPOSED ADJACENT A PRESSURE RELIEF PASSAGE TO FACILITATE A PRESSURE RELIEF FUNCTION OF SAME

INCORPORATION BY REFERENCE

The disclosure of Japanese Patent Application No. 2017-250286 filed on Dec. 27, 2017, including the specification, drawings and abstract, is incorporated herein by reference in its entirety.

BACKGROUND OF THE INVENTION

1. Field of the Invention

The invention relates to pump apparatuses.

2. Description of the Related Art

A pump apparatus known in the related art includes a vane pump or a gear pump that functions as a hydraulic pressure supply source to supply a working fluid, such as oil, to a hydraulically operated machine. In one example, the pump apparatus supplies pressurized oil to components of a vehicle, such as a transmission. During this operation, the pump apparatus receives power from a rotational driving force of an engine, for example, so as to pump up oil. The pump apparatus adjusts the pressure of the pumped up oil by, for example, an electromagnetic pressure regulating valve and supplies the resulting oil to components of a vehicle, such as a transmission.

Such a pump apparatus, however, is unable to adjust the pressure of the oil in the event of a malfunction in the pressure regulating valve because the pump apparatus adjusts the pressure of the oil by only the pressure regulating valve. This may result in a situation where the pressure of the oil supplied to the transmission, for example, is higher than necessary, making it impossible to successfully control the transmission.

To cope with such a situation, Japanese Patent Application Publication No. 2016-050505 (JP 2016-050505 A) discloses a pump apparatus that includes a pressure relief valve disposed on a hydraulic line between a vane pump and a pressure regulating valve. Thus, if the pressure of oil becomes higher than necessary, the pressure relief valve would open at a predetermined upper limit pressure value so as to relieve the pressure of the hydraulic line. This accordingly reduces an increase in the pressure of oil to be supplied to a transmission and thus precludes malfunctions in the transmission and the pump apparatus caused by an excessively high pressure. Unfortunately, the pressure relief valve is added to the pump apparatus externally, resulting in an increase in cost. What is now much desired is an inexpensive pump apparatus that includes no external pressure relief valve.

SUMMARY OF THE INVENTION

An object of the invention is to provide an inexpensive pump apparatus that incorporates a pressure relief function.

An aspect of the invention provides a pump apparatus including a housing, a shaft, a rotator, a pressure relief passage, and a bearing. The housing includes a suction port and a discharge port. The shaft is rotatably supported in the housing. The rotator is disposed in the housing. The rotator is configured to rotate in accordance with rotation of the shaft so as to transfer hydraulic oil to the discharge port. The hydraulic oil is sucked from the suction port. The pressure relief passage is defined in a portion of the housing facing an outer peripheral surface of the shaft. The pressure relief passage is configured to bring the discharge port into communication with a low pressure region where the hydraulic oil is low in pressure. The bearing is disposed on the pressure relief passage. The bearing supports the shaft such that the shaft is rotatable relative to the housing. When a pressure of the hydraulic oil in the discharge port is lower than a first predetermined pressure, the bearing keeps the pressure relief passage out of communication with an adjacent hydraulic oil passage. When the pressure of the hydraulic oil in the discharge port has increased to reach or exceed the first predetermined pressure, the bearing axially moves relative to the housing so as to bring the pressure relief passage into communication with the adjacent hydraulic oil passage.

The pump apparatus according to this aspect internally includes the pressure relief passage. The bearing is disposed on the pressure relief passage. The bearing is moved so as to bring the pressure relief passage into communication with the adjacent hydraulic oil passage. The bearing thus has not only the function of supporting the shaft but also a pressure relief function. This makes it possible to inexpensively manufacture the pump apparatus having the pressure relief function.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
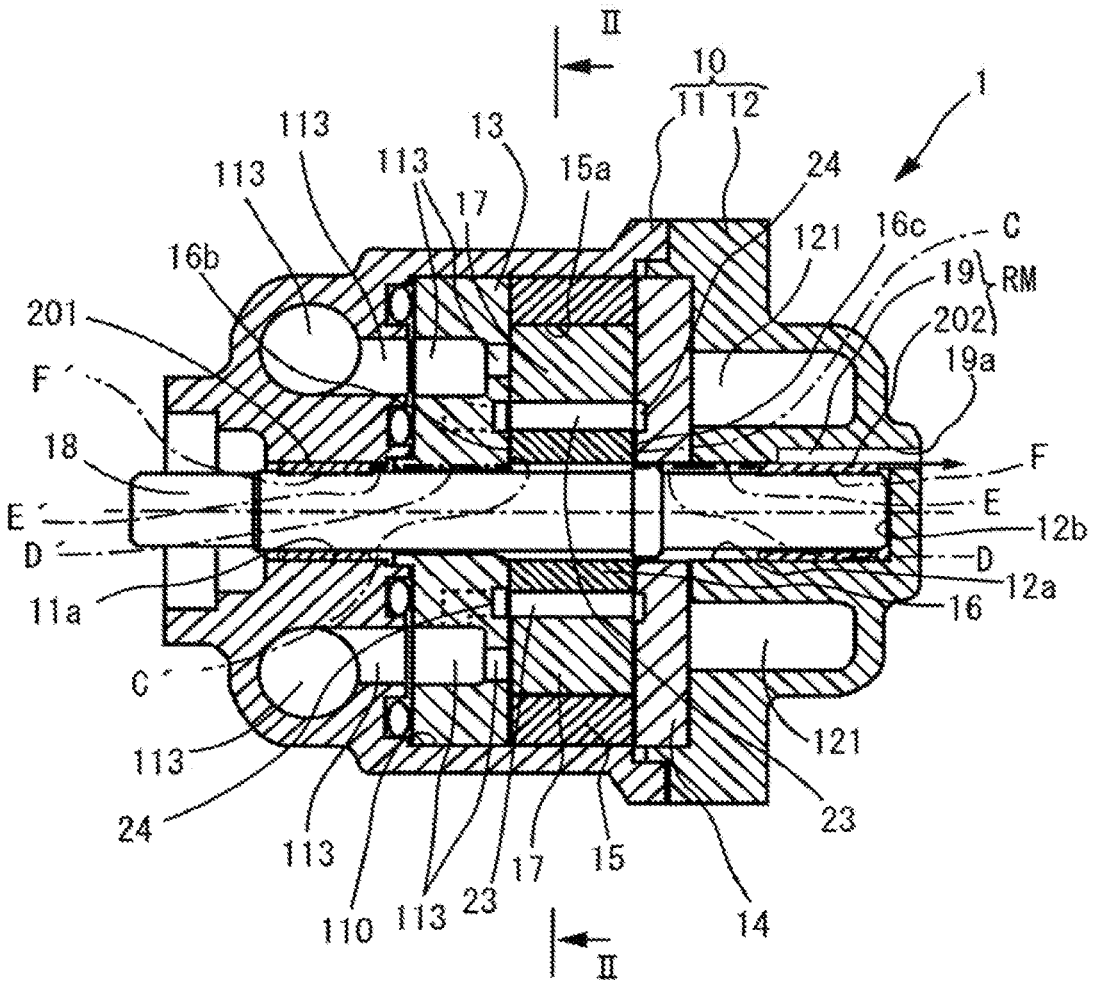
FIG. 1 is an axial cross-sectional view of a pump apparatus according to a first embodiment of the invention.
Figure 2:
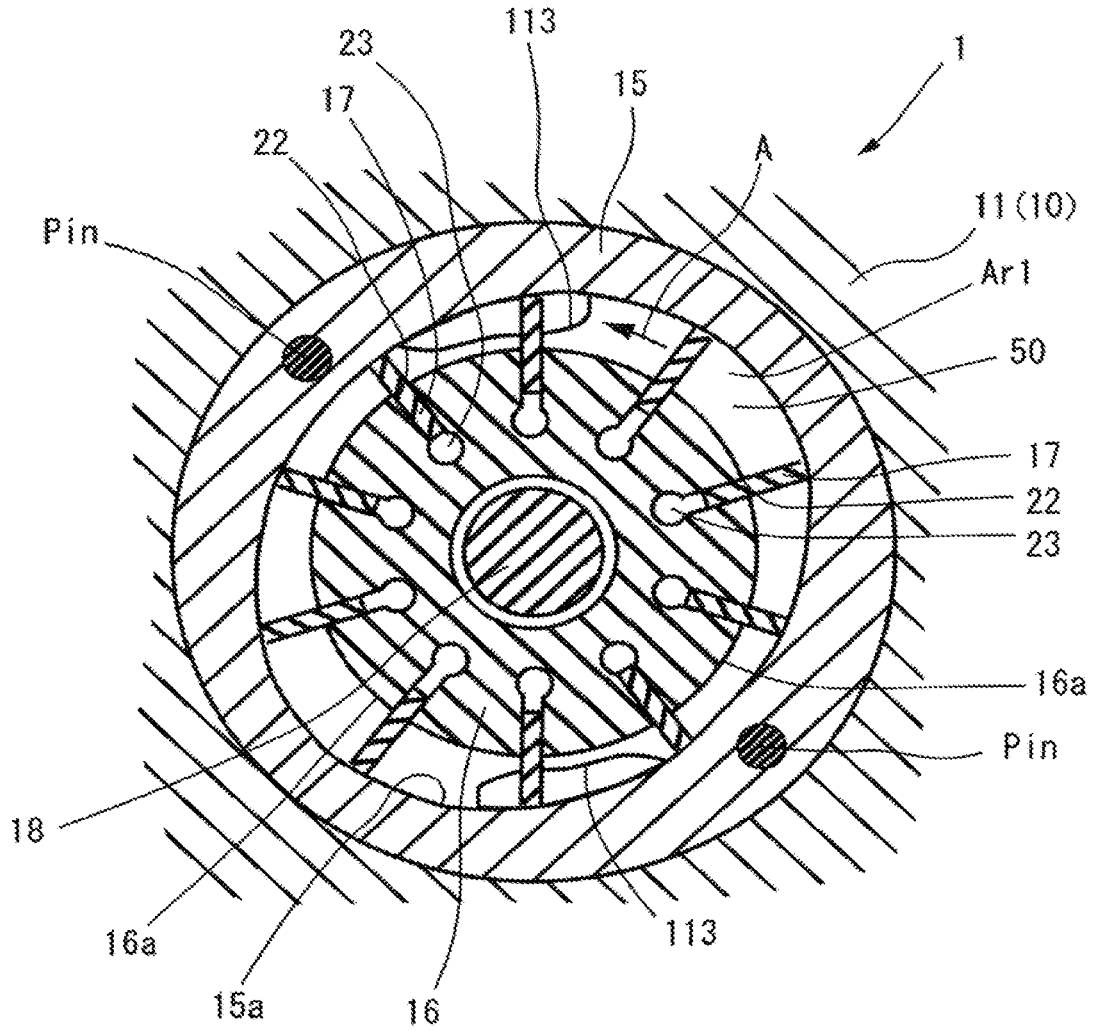
FIG. 2 is a cross-sectional view taken along the line II-II in FIG. 1.

A first embodiment of the invention will be described in detail with reference to FIGS. 1 to 6. FIG. 1 is an axial cross-sectional view of a pump apparatus 1 according to a first embodiment of the invention. FIG. 2 is a cross-sectional view of the pump apparatus 1 taken along the line II-II in FIG. 1.

The pump apparatus 1 is housed in a gearbox casing for an automatic transmission of an automobile, for example. The pump apparatus 1 is an oil pump to pump up hydraulic oil stored in an oil pan inside the gearbox casing so as to pressure-feed the hydraulic oil to the components of the transmission.

The pump apparatus 1 includes a housing 10, a side plate 13, a side plate 14, a cam ring 15, a rotor 16, a plurality of vanes 17, a shaft 18, a pressure relief passage 19, a bearing 201, and a bearing 202. The housing 10 includes a first housing 11 and a second housing 12. The side plates 13 and 14 are housed in the housing 10. The shaft 18 transmits a rotational force to the rotor 16. The bearings 201 and 202 are cylindrical sliding bearings. The pressure relief passage 19 and the bearing 202 are components of a pressure relief mechanism RM.

The side plates 13 and 14 and the cam ring 15 are non-rotatable relative to the housing 10. The rotor 16 and the vanes 17 rotate in one direction relative to the housing 10 upon receiving a rotational force transmitted from a driving source through the shaft 18. In the present embodiment, the driving source is an engine of the automobile. The arrow A in FIG. 2 indicates the direction of rotation of the rotor 16 and the vanes 17. The direction indicated by the arrow A will hereinafter be referred to as a "direction A". The rotor 16 and the vanes 17 are components of a rotator according to the invention.

The shaft 18 is rotatably supported in the housing 10. Specifically, the shaft 18 is rotatably supported by the bearing 201 disposed in the first housing 11 and the bearing 202 disposed in the second housing 12. The bearing 201 is press-fitted into a shaft insertion hole 11*a* defined in the first housing 11. The bearing 202 is press-fitted into a shaft insertion hole 12*a* defined in the second housing 12. The shaft insertion hole 12*a* includes a bottom surface 12*b* illustrated in the right portion of FIG. 1. As previously described, the bearing 202 disposed in the second housing 12 is a component of the pressure relief mechanism RM according to the invention. The bearing 202 will be described in more detail below.

Each of the bearings 201 and 202 is a cylindrical sliding bearing known in the related alt. The shaft 18 is inserted into the housing 10 and supported by the bearings 201 and 202. An axially central portion of the shaft 18 is coupled to the rotor 16. The left end of the shaft 18 in FIG. 1 protrudes out of the housing 10.

In the present embodiment, the axially central portion of the shaft 18 is spline-fitted to the rotor 16 (which is a component of the rotator), so that the rotor 16 and the shaft 18 rotate together. The left end of the shaft 18 in FIG. 1 is equipped with a sprocket (not illustrated). In one example, rotation of a pump impeller that is an output rotational member of a torque converter is transmitted to the sprocket through a chain. The shaft 18 rotates in accordance with the rotational force and the number of revolutions of the driving source (e.g., the engine installed on the automobile).

The first housing 11 and the second housing 12 are arranged along the axis of rotation of the shaft 18. A sheet seal (not illustrated) is interposed between the first housing 11 and the second housing 12. The first housing 11 and the second housing 12 are bolted to each other, with the seal located therebetween.

The first housing 11 defines a housing space 110 in which the side plate 13, the cam ring 15, the rotor 16, and the vanes 17 are housed. The side plate 13 is housed in a portion of the housing space 110 located adjacent to the bottom surface of the first housing 11 (i.e., a portion of the housing space 110 located opposite to the second housing 12).

The cam ring 15 is disposed in a portion of the housing space 110 located closer to an opening of the first housing 11 relative to the side plate 13 in the direction of the axis of the shaft 18. The cam ring 15 is non-rotatably secured to the inside of the housing space 110. The cam ring 15 includes an inner peripheral surface 15*a* that defines an elliptic cam surface (see FIG. 2). As illustrated in FIG. 2, the first housing 11 is provided with a pair of pins Pin. An end of each of the pins Pin is press-fitted into the first housing 11. The side plate 13 and the cam ring 15 are positioned and supported by the pins Pin such that the side plate 13 and the cam ring 15 are non-rotatable relative to the housing 10. The cam ring 15 is sandwiched between the side plate 13 and the side plate 14 housed in the second housing 12.

The rotor 16 and the vanes 17 that are components of the rotator are disposed inside the cam ring 15 (i.e., radially inward of the cam ring 15). The rotor 16 is rotatably disposed radially inward of the cam ring 15. The rotor 16 includes an outer peripheral surface 16*a*, and a plurality of housing grooves 22 (see FIG. 2) extending radially inward from the outer peripheral surface 16*a*.

As illustrated in FIG. 1, the rotor 16 includes an axial end face 16*b* adjacent to the side plate 13, and an axial end face 16*c* adjacent to the side plate 14. The housing grooves 22 extend to the axial end face 16*b* and the axial end face 16*c*. A portion of each of the vanes 17 is slidably housed in an associated one of the housing grooves 22.

Each of the vanes 17 is thus movable in a radial direction of the rotor 16. An end of each of the vanes 17 protrudes out of the associated housing groove 22 through the outer peripheral surface 16*a* of the rotor 16. A radially inward end of each housing groove 22 defines a back pressure chamber 23. Each back pressure chamber 23 receives a pressure for radially outwardly pushing the associated vane 17.

As illustrated in FIG. 1, the side plates 13 and 14 are each provided with a circumferentially extending back pressure groove 24. Hydraulic oil whose pressure has increased above a pressure (atmospheric pressure) P0 is supplied to the back pressure chambers 23 of the rotor 16 through the back pressure groove 24. Centrifugal force caused by rotation of the rotor 16 and the pressure of the hydraulic oil supplied to the back pressure chambers 23 push the vanes 17 outward from the housing grooves 22. This brings the ends of the vanes 17 into sliding contact with the inner peripheral surface 15*a* of the cam ring 15.

A circumferential space Ar1 is defined inside the cam ring 15 (i.e., radially inward of the cam ring 15). Specifically, the circumferential space Ar1 is defined between the inner peripheral surface 15*a* of the cam ring 15 and the outer peripheral surface 16*a* of the rotor 16. The circumferential space Ar1 is divided into a plurality of pump chambers 50 each defined by an associated pair of the vanes 17 adjacent to each other in the circumferential direction of the rotor 16. In the present embodiment, the pump apparatus 1 includes ten vanes 17 that rotate together with the rotor 16. Thus, ten pump chambers 50 are defined inside the cam ring 15.

As illustrated in FIG. 1, the pump apparatus 1 includes discharge ports 113 defined in the side plate 13 and the first housing 11. The discharge ports 113 function as a high pressure region. The discharge ports 113 are configured to be in communication with the pump chambers 50. Hydraulic oil compressed in the pump chambers 50 is discharged to the discharge ports 113. In the present embodiment, the pump apparatus 1 includes the discharge ports 113 defined at two circumferential locations.

The hydraulic oil compressed in the pump chambers 50 and discharged to the discharge ports 113 by rotation of the rotor 16 is supplied to a hydraulic line (not illustrated) of the transmission. The pressure of the hydraulic oil supplied to the hydraulic line (not illustrated) is adjusted to a predetermined pressure P1 by an electromagnetic pressure regulating valve (not illustrated) disposed outside the pump apparatus 1. In one example, the predetermined pressure P1 is in the range of 1 MPa to 5 MPa. As a result of this pressure adjustment, the pressure of the hydraulic oil in the discharge ports 113 connected to the hydraulic line is also adjusted to the pressure P1. The hydraulic oil in the hydraulic line (not illustrated), whose pressure has been adjusted to the pressure P1, activates actuators of the transmission.

The second housing 12 includes suction ports 121 and the pressure relief mechanism RM. The suction ports 121 are in communication with a low pressure region. The suction ports 121 suck low pressure hydraulic oil stored in an oil tank (not illustrated). The pressure of the low pressure hydraulic oil corresponds to the atmospheric pressure P0. In the present embodiment, the second housing 12 includes the suction ports 121 provided at two locations (see the dashed lines 121 in FIG. 2). The suction ports 121 in FIG. 1 are illustrated schematically. The locations of the suction ports 121 in FIG. 1 do not necessarily correspond to the actual locations of the suction ports 121. The same goes for the discharge ports 113 illustrated in FIG. 1.

The suction ports 121 are in communication with an inlet (not illustrated) of the second housing 12. The inlet is configured to be in communication with a reservoir of the oil pan inside the gearbox casing so as to suck the hydraulic oil stored in the reservoir.

As illustrated in FIG. 2, the inner peripheral surface 15*a* of the cam ring 15 has an elliptic shape. Rotation of the rotor 16 in the direction A thus moves the vanes 17 along the inner peripheral surface 15*a* (i.e., the cam surface) of the cam ring 15 so as to increase or reduce the volume of each pump chamber 50. During the passage of predetermined ones of the pump chambers 50 through the suction ports 121 (see the dashed lines 121 in FIG. 2) in the circumferential direction, the predetermined ones of the pump chambers 50 gradually increase in volume. This causes the hydraulic oil to be sucked into the pump chambers 50 from the suction ports 121.

Subsequently, the predetermined ones of the pump chambers 50 further rotate in the direction A, approach the discharge ports 113, and then gradually decrease in volume. Thus, the hydraulic oil in the pump chambers 50 approaches the discharge ports 113 while being compressed, and is then discharged to the discharge ports 113.

As described above, the rotation of the rotor 16 and the vanes 17 compresses the hydraulic oil in a low pressure state (i.e., an atmospheric pressure state) sucked from the suction ports 121 (which are in communication with the low pressure region), increases the pressure of the hydraulic oil, and then transfers the resulting hydraulic oil to the discharge ports 113. As previously mentioned, the pressure regulating valve on the hydraulic line connected to the discharge ports 113 is controlled so as to adjust the pressure of the hydraulic oil in the discharge ports 113 to the pressure P1. The amount of hydraulic oil flowing into the discharge ports 113 increases or decreases in proportion to the rotational speed of the rotor 16.

Figure 3:
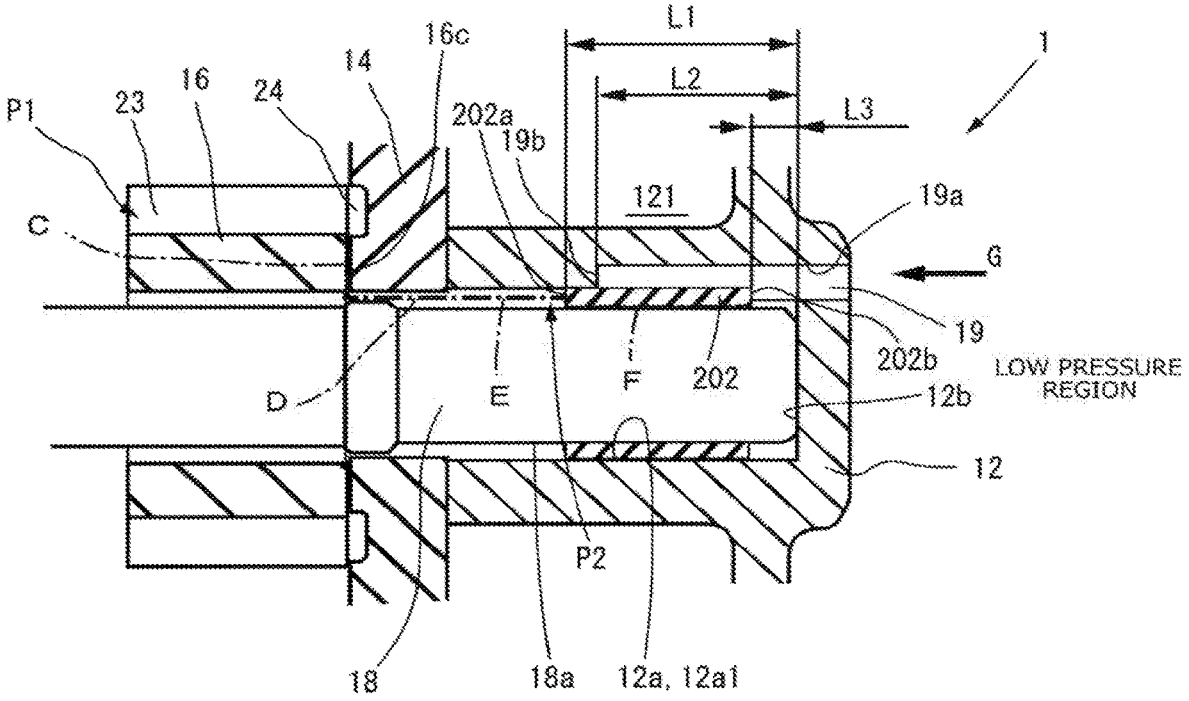
FIG. 3 is an enlarged cross-sectional view of a pressure relief mechanism and adjacent components in FIG. 1.

As a result of this pressure adjustment, a pressure equal to or substantially equal to the pressure P1 in the discharge ports 113 is applied to the back pressure chambers 23 of the rotor 16 and the back pressure groove 24 of the side plate 14 in communication with the back pressure chambers 23. As illustrated in FIGS. 1 and 3, the hydraulic oil thus flows from the back pressure groove 24 to the low pressure region (i.e., the atmospheric pressure region) where the pressure is the atmospheric pressure P0 through a passage C, a passage D, a passage E, and a passage F. The passages C to F are slight gaps defined between the components of the pump apparatus 1. As used herein, the term "low pressure region" refers to an atmospheric pressure space located outside the pump apparatus 1. In the present embodiment, the low pressure region is a region of the oil tank in the gearbox casing where the hydraulic oil is stored.

As illustrated in FIG. 3, the passage C is a gap defined between the axial end face 16*c* of the rotor 16 and the side plate 14. The passage D is a gap defined between an outer peripheral surface 18*a* of the shaft 18 and the inner peripheral surface of the side plate 14 facing the outer peripheral surface 18*a*. The passage E is a gap defined between the outer peripheral surface 18*a* of the shaft 18 and the shaft insertion hole 12*a* of the housing 10. The passage F is a gap defined between the outer peripheral surface 18*a* of the shaft 18 and the inner peripheral surface of the bearing 202.

The hydraulic oil flows to the passages C to F from the back pressure groove 24. A relatively large pressure P2 caused by the hydraulic oil is thus applied to an end face 202*a* of the bearing 202 located adjacent to the passage E. The pressure P2 of the hydraulic oil applied to the end face 202*a*, however, is normally smaller than the pressure P1 in the discharge ports 113. The pressure P1 in the discharge ports 113 is equal to the pressure P1 in the back pressure groove 24. The relationship between the pressure P2 and the pressure P1 is represented as P2<P1. Of the passages C to F, the passage F has the smallest cross-sectional area. The passage F thus functions as a throttle.

The structure of the pressure relief mechanism RM will be described below with reference to FIGS. 1, 3, and 4. As already mentioned, the pressure relief mechanism RM includes the pressure relief passage 19 and the bearing 202. During operation of the pump apparatus 1, the pressure relief mechanism RM according to the present embodiment performs a pressure relief function using the pressure P2 of the hydraulic oil applied to the end face 202*a* of the bearing 202 adjacent to the passage E as described above.

Figure 4:
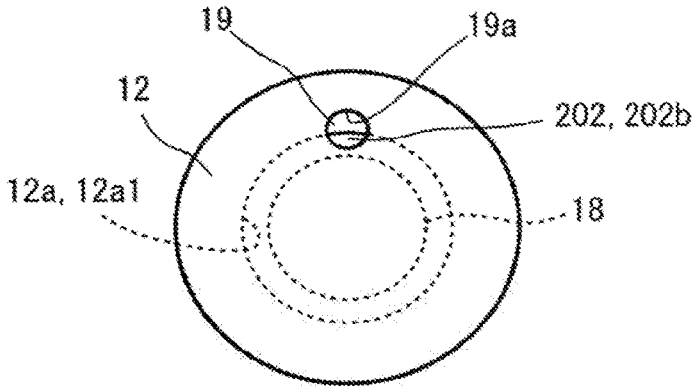
FIG. 4 is a diagram illustrating a pressure relief passage when viewed in a direction G in FIG. 3.

As illustrated in FIG. 4, the pressure relief passage 19 is defined in a portion of the second housing 12 (which is a component of the housing 10) facing the outer peripheral surface 18*a* of the shaft 18. The pressure relief passage 19 includes an inner peripheral surface 19*a*. Suppose that activation of the pressure relief mechanism RM moves the bearing 202 rightward along its axis in FIG. 1 so as to bring the pressure relief passage 19 into communication with the passage E. In this case, the discharge ports 113 are brought into communication with the inside of the gearbox casing, where the pressure of the hydraulic oil is low, through the passages C to F.

As previously mentioned, the pressure in the discharge ports 113 is equal to or substantially equal to the pressure in the back pressure chambers 23 of the rotor 16 and the pressure in the back pressure groove 24 in communication with the back pressure chambers 23. Passages C' to F' similar to the passages C to F are defined in a portion of the pump apparatus 1 located in the left portion of FIG. 1 where the first housing 11 is located. The passages C' to F' make it possible to provide another pressure relief mechanism similar to the pressure relief mechanism RM. In the first embodiment, however, no pressure relief mechanism RM is provided in the portion of the pump apparatus 1 where the first housing 11 is located.

The pressure relief passage 19 is a passage (i.e., a hole) defined in a circumferential portion of the second housing 12 adjacent to an inner peripheral surface 12*a*1 of the shaft insertion hole 12*a*. In the present embodiment, the pressure relief passage 19 is disposed at a single location. Specifically, the process of defining the pressure relief passage 19 involves making a hole in the portion of the second housing 12 by moving, for example, a drill in a direction Gin FIG. 3. A portion of the pressure relief passage 19 overlapping with the bearing 202 along the axis of the shaft 18 is substantially semicircular in a cross section perpendicular to the axis of the shaft 18 (see FIG. 4). As illustrated in FIG. 3, the pressure relief passage 19 has a length L1 between the bottom surface 12*b* of the shaft insertion hole 12*a*, into which the shaft 18 is inserted, and an end 19*b* of the pressure relief passage 19. The length L1 will be described below in more detail.

The bearing 202 is disposed on the pressure relief passage 19. As illustrated in FIGS. 1 and 3, the bearing 202 is disposed such that the bearing 202 at least partially overlaps with the pressure relief passage 19 along the axis of the shaft 18. Under a load F1, the bearing 202 is press-fitted to the inner peripheral surface 12*a*1 of the shaft insertion hole 12*a* of the second housing 12 (which is a component of the housing 10) such that the end face 202*a* is located closer to the passage E relative to the end 19*b* of the pressure relief passage 19. The bearing 202 is disposed such that the distance between the bottom surface 12*b* of the shaft insertion hole 12*a* and the end face 202*a* of the bearing 202 corresponds to a distance L2.

Suppose that the distance between the bottom surface 12*b* of the shaft insertion hole 12*a* and an end face 202*b* of the bearing 202 located opposite to the end face 202*a* along the axis of the shaft 18 is a distance L3. In this case, the length L1, the distance L2, and the distance L3 have the following relationship: L3>(L2−L1). The load F1, the distance L2, and the distance L3 will be described in more detail below.

The following description describes how the pump apparatus 1 having the above-described structure operates and how the length L1, the distance L2, and the distance L3 related to the placement of the pressure relief mechanism RM are set. The engine supplies a driving force to the shaft 18 of the pump apparatus 1 through the sprocket so as to rotate the shaft 18. The rotation of the shaft 18 rotates the rotor 16 inside the cam ring 15. In a suction step, the rotation of the rotor 16 causes the predetermined ones of the pump chambers 50, deviated from each other by 180 degrees, to increase in volume, so that the hydraulic oil is sucked into the predetermined ones of the pump chambers 50 from the suction ports 121.

In a compression step, further rotation of the rotor 16 gradually reduces the volume of the predetermined ones of the pump chambers 50 and compresses the oil sucked into the predetermined ones of the pump chambers 50. Then, the predetermined ones of the pump chambers 50 further decrease in volume in a discharge step. In the discharge step, the hydraulic oil is supplied from the predetermined ones of the pump chambers 50 to the discharge ports 113 defined in the side plate 13 and the first housing 11 (which is a component of the housing 10).

The hydraulic oil supplied to the discharge ports 113 is then supplied to the hydraulic line (not illustrated) of the transmission. The pressure of the hydraulic oil supplied to the hydraulic line (not illustrated) is adjusted to the predetermined pressure P1 by the electromagnetic pressure regulating valve (not illustrated) disposed outside the pump apparatus 1. In one example, the pressure P1 is in the range of 1 MPa to 5 MPa. The present embodiment is described on the assumption that the pressure P1 is 5 MPa. Under normal conditions, the hydraulic oil whose pressure has been adjusted to the pressure P1 (5 MPa) makes it possible to successfully control the actuators of the transmission (see the range "NORMAL OPERATION" illustrated in the graph of FIG. 5).

The pressure regulating valve on the hydraulic line, however, may malfunction and fail to make a pressure adjustment. In such a case, the pressure P1 of the hydraulic oil in the discharge ports 113 may considerably exceed a pressure suitable for control of the transmission, resulting in an excessive pressure PNG. In one example, the pressure suitable for control of the transmission is 5 MPa, and the excessive pressure PNG is 30 MPa or more. The excessive pressure PNG may cause defective conditions, such as deformation of component(s) on the hydraulic line of the transmission and/or component(s) of the pump apparatus 1. This may make it impossible for the pump apparatus 1 and/or the transmission to perform intended functions.

Figure 5:
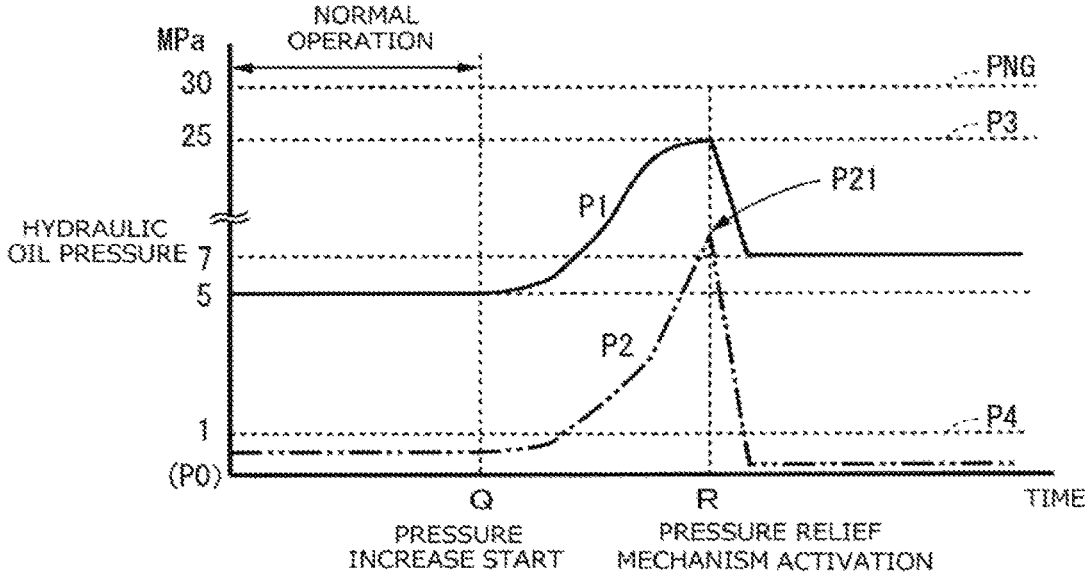
FIG. 5 is a graph illustrating the relationship between elapsed time and the pressure of hydraulic oil (i.e., a pressure P1 of hydraulic oil in discharge ports 113 and a pressure P2 of hydraulic oil in a passage E) measured before and after activation of the pressure relief mechanism.
Figure 6:
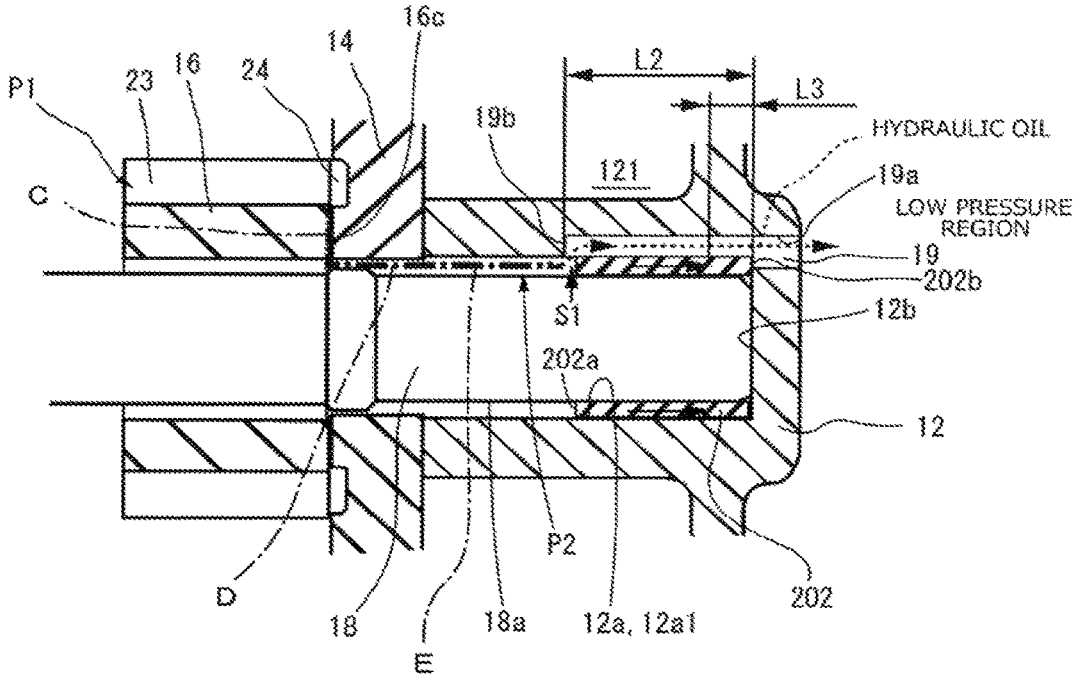
FIG. 6 is a diagram illustrating the pressure relief mechanism during operation.

To solve this problem, the present embodiment involves activating the pressure relief mechanism RM at a time R if the pressure (discharge pressure) P1 in the discharge ports 113 has exceeded the pressure suitable for normal control of the transmission. The pressure suitable for normal control of the transmission may be 5 MPa. In FIG. 5, the pressure P1 is higher than the pressure suitable for normal control of the transmission in the region rightward of a time Q. As illustrated in FIG. 6, the activation of the pressure relief mechanism RM brings the pressure relief passage 19 into communication with the passage E by an area S1. The pressure P1 in the discharge ports 113 is thus maintained at or below a first predetermined pressure P3 lower than the excessive pressure PNG. In one example, the first predetermined pressure P3 is 25 MPa. The pressure P1 in the discharge ports 113 may be maintained at 7 MPa.

In the present embodiment, the area S1 is set such that the pressure (discharge pressure) in the discharge ports 113 is prevented from exceeding the excessive pressure PNG (30 MPa) and the actuators of the transmission are controllable. A method for setting the area S1 will be described below.

In one example, the minimum pressure in the discharge ports 113 that enables control of the actuators on the hydraulic line is 1 MPa (see FIG. 5). The minimum pressure in the discharge ports 113 is equivalent to a second predetermined pressure P4. The area S1 of the pressure relief mechanism RM is set such that the pressure P1 of the hydraulic oil in the discharge ports 113 falls between the first predetermined pressure P3 and the second predetermined pressure P4 lower than the first predetermined pressure P3 (i.e., such that the pressure P1 falls between 25 MPa and 1 MPa). The distance L3 by which the bearing 202 axially moves is set in accordance with the area S1.

In actuality, with the aim of enabling the pressure relief mechanism RM to perform the above-described operations, an experiment is conducted so as to determine the correlation between the pressure P1 of the hydraulic oil in the discharge ports 113 and the pressure P2 of the hydraulic oil in the passage E associated with the pressure P1. Then, the first predetermined pressure P3 of the hydraulic oil in the discharge ports 113 is set at 25 MPa, for example. A pressure P21 of the hydraulic oil in the passage E associated with the first predetermined pressure P3 (25 MPa) is determined on the basis of the result of the experiment. In one example, the pressure P21 is 7 MPa.

The first predetermined pressure P3 is 30 MPa or less and preferably as close as possible to 30 MPa. If the first predetermined pressure P3 is too close to 30 MPa, however, operating variations of the pressure relief mechanism RM may cause the pressure P1 of the hydraulic oil in the discharge ports 113 to exceed 30 MPa. By way of example, the present embodiment thus involves setting the first predetermined pressure P3 at 25 MPa in consideration of operating variations of the pressure relief mechanism RM.

An increase in the pressure P1 in the discharge ports 113 may activate the pressure relief mechanism RM, and then the engine speed, for example, may decrease, resulting in a reduction in the number of rotations of the shaft 18 of the pump apparatus 1. If such a situation occurs, setting the first predetermined pressure P3 at 25 MPa would make it likely that the pressure P1 of the hydraulic oil in the discharge ports 113 will be maintained at or above 1 MPa corresponding to the second predetermined pressure P4. This process is described by way of example only. The first predetermined pressure P3 may be higher or lower than 25 MPa.

To enable the pressure relief mechanism RM to perform the above-described operations, the area S1 by which the pressure relief passage 19 is to be in communication with the passage E is set in accordance with the pressure P21 of the hydraulic oil in the passage E. Specifically, the present embodiment involves calculating the area S1 that causes the hydraulic oil, whose pressure is the pressure P21 in the passage E, to flow into the pressure relief passage 19, so that the pressure P1 in the discharge ports 113 equivalent to the first predetermined pressure P3 (which may be 25 MPa) is reduced to, for example, about 7 MPa as illustrated in the graph of FIG. 5.

As illustrated in the graph of FIG. 5, the present embodiment involves activating the pressure relief mechanism RM at the time R so as to bring the pressure relief passage 19 into communication with the passage E by the area S1. This reduces the pressure P2 of the hydraulic oil in the passage E to a level close to the atmospheric pressure. The pressure P1 in the discharge ports 113, however, is maintained at about 7 MPa, for example. This makes it possible to suppress defective conditions, such as deformation of component(s) on the hydraulic line of the transmission and component(s) of the pump apparatus 1, and to successfully control the actuators of the transmission.

The length L1 of the pressure relief passage 19 between the bottom surface 12*b* of the shaft insertion hole 12*a* and the end 19*b* of the pressure relief passage 19 and the distance L2 between the bottom surface 12*b* and the end face 202*a* of the bearing 202 are set such that the pressure relief passage 19 is brought into communication with the passage E by the area S1 calculated.

The load F1 by which the bearing 202 is to be press-fitted to the inner peripheral surface 12*a*1 of the shaft insertion hole 12*a* is set such that the bearing 202 axially moves by the distance L3 when the end face 202*a* of the bearing 202 receives the pressure P21 of the hydraulic oil in the passage E associated with the first predetermined pressure P3 (which may be 25 MPa).

The load F1 is calculated by Eq. (1), where S2 denotes the area of the end face 202*a* of the bearing 202, and P21 denotes the pressure of the hydraulic oil in the passage E.

$$F1=P21\times S2. \ldots \text{Eq.} \quad (1)$$

Alternatively, the load F1 may be calculated by repeatedly conducting experiments instead of using Eq. (1).

When the pressure P1 of the hydraulic oil in the discharge ports 113 is lower than the first predetermined pressure P3, the bearing 202 keeps the pressure relief passage 19 out of communication with the passage E as illustrated in FIG. 3. In this state, the bearing 202 does not axially move because the pressure P2 of the hydraulic oil in the passage E is lower than the pressure P21 associated with the first predetermined pressure P3. This maintains the state in which the end face 202*a* of the bearing 202 is located closer to the passage E relative to the end 19*b* of the pressure relief passage 19. Accordingly, the bearing 202 is located between the pressure relief passage 19 and the passage E so as to keep the pressure relief passage 19 out of communication with the passage E.

The electromagnetic pressure regulating valve (not illustrated) on the hydraulic line of the transmission may malfunction and fail to make a pressure adjustment, causing the pressure P1 of the hydraulic oil in the discharge ports 113 to reach or exceed the first predetermined pressure P3. In such a case, at least the pressure P21 associated with the first predetermined pressure P3 is applied to the end face 202*a* of the bearing 202. Upon receiving the pressure P21 on the end face 202*a*, the bearing 202 is urged rightward along its axis and thus moved relative to the second housing 12 (which is a component of the housing 10) by the distance L3 (see FIG. 3). The end face 202*b* of the bearing 202 then abuts against the bottom surface 12*b*, bringing the bearing 202 to a halt (see FIG. 6).

The length L1, the distance L2, and the distance L3 have the following relationship: L3>(L2−L1). The axial movement of the bearing 202 by the distance L3 brings the pressure relief passage 19 into communication with the passage E by the area S1. The hydraulic oil in the discharge ports 113 then flows into the gearbox casing (i.e., the low pressure region) through the back pressure chambers 23, the back pressure groove 24, the passage C, the passage D, the passage E, and the pressure relief passage 19.

The pressure P1 of the hydraulic oil in the discharge ports 113 and the pressure in the hydraulic line of the transmission connected to the discharge ports 113 thus fall between the first predetermined pressure P3 (which may be 25 MPa) and the second predetermined pressure P4 (which may be 1 MPa). Alternatively, no second predetermined pressure P4 may be set, and the pressure P1 in the discharge ports 113 may be reduced to the atmospheric pressure. Such an alternative embodiment prevents at least deformation of component(s) on the hydraulic line of the transmission and component(s) of the pump apparatus 1 or damage to component(s) on the hydraulic line of the transmission and component(s) of the pump apparatus 1.

In the first embodiment, the pump apparatus 1 includes the rotor 16 and the vanes 17 (which are components of the rotator) disposed in the housing 10. The rotor 16 and the vanes 17 rotate in accordance with rotation of the shaft 18 so as to increase the pressure of the low pressure hydraulic oil sucked from the suction ports 121 and transport the resulting hydraulic oil to the discharge ports 113. The pump apparatus 1 includes the pressure relief passage 19 defined in a portion of the second housing 12 (which is a component of the housing 10) facing the outer peripheral surface 18*a* of the shaft 18. The pressure relief passage 19 is configured to bring the discharge ports 113 into communication with the low pressure region where the pressure of the hydraulic oil is low.

The pump apparatus 1 includes the bearing 202 disposed on the pressure relief passage 19. The bearing 202 supports the shaft 18 such that the shaft 18 is rotatable relative to the second housing 12. When the pressure P1 of the hydraulic oil in the discharge ports 113 is lower than the first predetermined pressure P3, the bearing 202 keeps the pressure relief passage 19 out of communication with the passage E. When the pressure P1 of the hydraulic oil in the discharge ports 113 is increased to reach or exceed the first predetermined pressure P3, the bearing 202 axially moves relative to the housing 10 so as to bring the pressure relief passage 19 into communication with the passage E.

In the first embodiment, the pressure relief passage 19 is disposed not outside but inside the pump apparatus 1. The bearing 202 is disposed on the pressure relief passage 19 and moved axially so as to bring the pressure relief passage 19 into communication with the passage E. The bearing 202 thus has not only the function of supporting the shaft 18 but also the pressure relief function. This makes it possible to inexpensively manufacture the pump apparatus 1 having the pressure relief function.

In the first embodiment, the pressure relief passage 19 is defined in a portion of the second housing 12 (which is a component of the housing 10) adjacent to the inner peripheral surface 12*a*1 of the shaft insertion hole 12*a*. The bearing 202 is attached to the inner peripheral surface 12*a*1 of the shaft insertion hole 12*a*. This enables a normal bearing structure to function as a pressure relief mechanism by merely defining the pressure relief passage 19 in the portion of the second housing 12 adjacent to the inner peripheral surface 12*a*1 of the shaft insertion hole 12*a*. Consequently, the first embodiment significantly facilitates the manufacture of the pump apparatus 1 having the pressure relief function and thus considerably reduces the manufacturing cost of the pump apparatus 1.

The first embodiment involves activating the pressure relief mechanism RM so as to bring the pressure relief passage 19 into communication with the passage E when the pressure P1 of the hydraulic oil in the discharge ports 113 has increased to reach or exceed the first predetermined pressure P3. This causes the hydraulic oil in the discharge ports 113 to flow into the pressure relief passage 19 through the passage C extending along a lateral surface of the rotor 16 that is a component of the rotator. Thus, the passage C extending along the lateral surface of the rotor 16 included in the pump apparatus 1 is used as a passage for the pressure relief function. This makes it possible to inexpensively provide the pressure relief mechanism RM.

In the first embodiment, the bearing 202 of the pressure relief mechanism RM axially moves by the distance L3 so as to bring the pressure relief passage 19 into communication with the passage E when the pressure P1 of the hydraulic oil in the discharge ports 113 has increased to reach or exceed the first predetermined pressure P3. The distance L3 is set such that the pressure P1 of the hydraulic oil in the discharge ports 113 falls between the first predetermined pressure P3 and the second predetermined pressure P4 lower than the first predetermined pressure P3.

In the first embodiment, the second predetermined pressure P4 is set at a level that enables activation of the actuators of the transmission so as to allow the vehicle to keep running. Thus, if the pressure P1 of the hydraulic oil in the discharge ports 113 has increased to reach or exceed the first predetermined pressure P3 and activated the pressure relief mechanism RM, the vehicle would keep running, giving a driver sufficient time to move the vehicle to a safe place.

In the first embodiment, the low pressure region is located in the atmospheric pressure space outside the pump apparatus 1. Specifically, the low pressure region is an inner space of the gearbox casing where the hydraulic oil is stored. Thus, the pump apparatus 1 to be attached to the inside of the gearbox casing is provided at a low cost, because the outlet of the pressure relief passage 19 does not have to be provided with any special passage.

In the first embodiment, the pump apparatus 1 includes the cam ring 15 non-rotatably secured to an inner portion of the housing 10. The cam ring 15 includes the inner peripheral surface 15*a* that defines the cam surface. The pump apparatus 1 includes the rotor 16 and the vanes 17 that are components of the rotator. The rotor 16 is rotatably disposed radially inward of the cam ring 15. The rotor 16 includes the housing grooves 22 and the back pressure chambers 23. The housing grooves 22 extend radially inward from the outer peripheral surface 16*a* of the rotor 16. The back pressure chambers 23 are each defined in the radially inward end of an associated one of the housing grooves 22. The back pressure chambers 23 are in communication with the discharge ports 113. The vanes 17 are each slidably housed in an associated one of the housing grooves 22. The vanes 17 divide the circumferential space Ar1 between the cam surface and the outer peripheral surface 16*a* of the rotor 16 into the pump chambers 50.

When the pressure P1 of the hydraulic oil in the discharge ports 113 has increased to reach or exceed the first predetermined pressure P3, the bearing 202 axially moves so as to bring the pressure relief passage 19 into communication with the passage E. In this case, the hydraulic oil stored in the back pressure chambers 23 flows along the lateral surface of the rotor 16 and then flows into the pressure relief passage 19. The pump apparatus 1 thus functions as a vane pump. Because the distance between the shaft 18 and each back pressure chamber 23 of the rotor 16 is short, the hydraulic oil in the back pressure chambers 23 is likely to flow along the lateral surface of the rotor 16 and the outer peripheral surface 18*a* of the shaft 18 and then flow out of the pump apparatus 1. The pump apparatus 1 according to the first embodiment of the invention includes the pressure relief mechanism RM that includes the bearing 202 disposed radially outward of the shaft 18. The first embodiment involves moving the bearing 202 of the pressure relief mechanism RM by effectively using the pressure of the hydraulic oil that flows along the lateral surface of the rotor 16 and the outer peripheral surface 18*a* of the shaft 18 and then flows out of the pump apparatus 1. Activating the pressure relief mechanism RM including the bearing 202 effectively reduces the pressure in the discharge ports 113.

Figure 7:
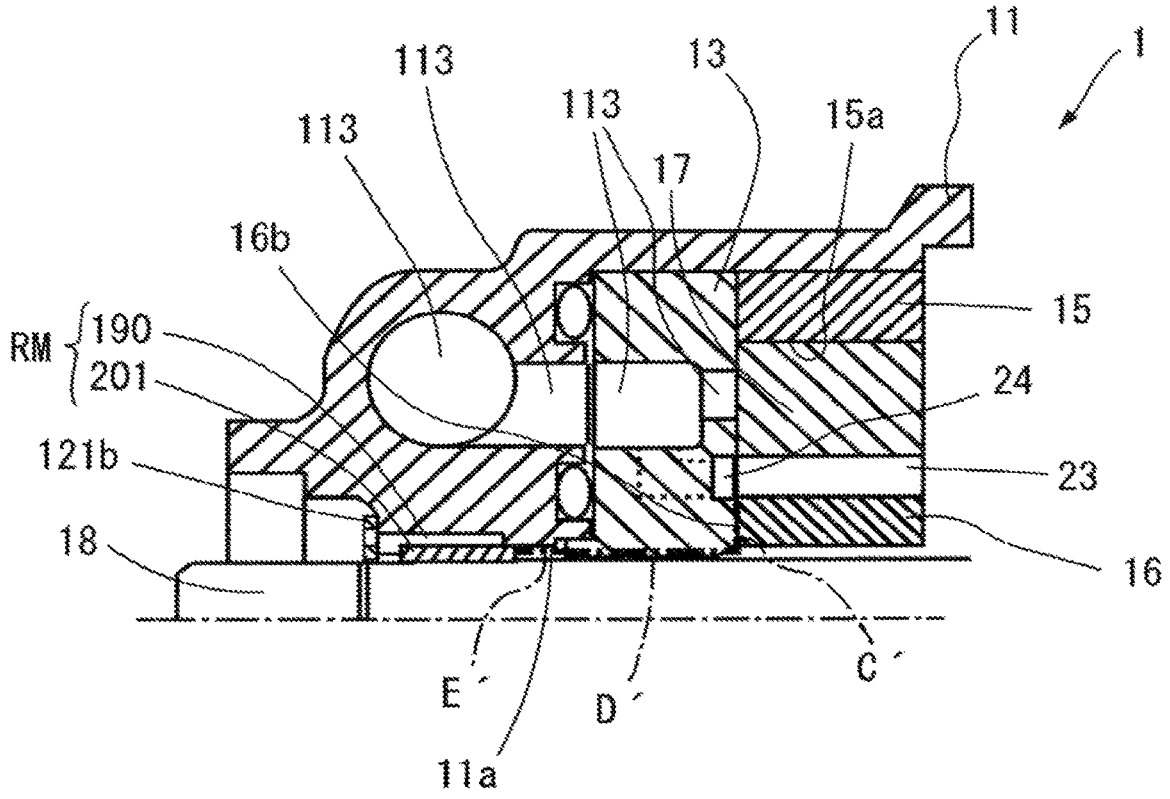
FIG. 7 is a diagram illustrating a first variation of the first embodiment.

In the first embodiment, the pressure relief mechanism RM is disposed in the second housing 12 located in the right portion of the pump apparatus 1 in FIG. 1. Alternatively, the pressure relief mechanism RM may be disposed at any other suitable location. FIG. 7 illustrates a first variation of the first embodiment. In the first variation, the pressure relief mechanism RM is disposed in the first housing 11 (which is a component of the housing 10) located in the left portion of the pump apparatus 1 in FIG. 7. In the first variation, the pressure relief mechanism RM includes the bearing 201 and a pressure relief passage 190. The hydraulic oil flows into the pressure relief passage 190 from the back pressure groove 24 through the passage C', the passage D', and the passage E' that are slight gaps. The relative locations of the pressure relief passage 190 and the bearing 201 are similar to those of the pressure relief passage 19 and the bearing 202 in the first embodiment. The bearing 201 is press-fitted into the shaft insertion hole 11*a* of the first housing 11 in a manner similar to that in which the bearing 202 is press-fitted into the shaft insertion hole 12*a* of the second housing 12.

In the first embodiment, the bottom surface 12*b* functions as a stopper to restrict rightward movement of the bearing 202 along its axis. In the first variation, the pump apparatus 1 includes a stopper 121*b* to restrict leftward movement of the bearing 201 along its axis. As illustrated in FIG. 7, the stopper 121*b* is secured to the outer end face of the shaft insertion hole 11*a* into which the bearing 201 is to be press-fitted. This enables the pressure relief mechanism RM according to the first variation to achieve functions and effects similar to those of the pressure relief mechanism RM according to the first embodiment. Alternatively, the pump apparatus 1 may be provided with both of the pressure relief mechanism RM according to the first variation and the pressure relief mechanism R14 according to the first embodiment. This also achieves the effects described above.

Figure 8:
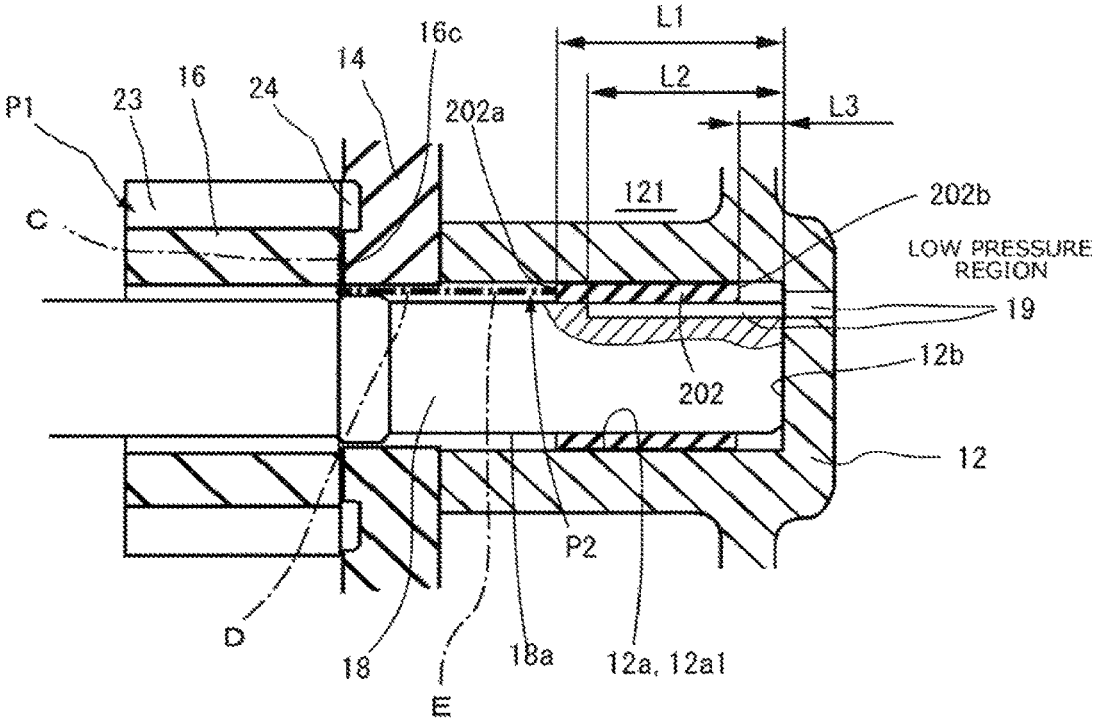
FIG. 8 is a diagram illustrating a second variation of the first embodiment.

The pressure relief mechanism RM according to the first embodiment includes: the pressure relief passage 19 defined in a portion of the second housing 12 (which is a component of the housing 10) adjacent to the inner peripheral surface 12*a*1 of the shaft insertion hole 12*a*; and the bearing 202 attached to the inner peripheral surface 12*a*1 of the shaft insertion hole 12*a*. The invention, however, is not limited to this embodiment. FIG. 8 illustrates a second variation of the first embodiment. In the second variation, the pressure relief mechanism RM includes: the pressure relief passage 19 defined in a portion of the shaft 18 adjacent to the outer peripheral surface 18*a*; and the bearing 202 attached to the outer peripheral surface 18*a* of the shaft 18. This also achieves effects similar to those of the first embodiment.

Figure 9:
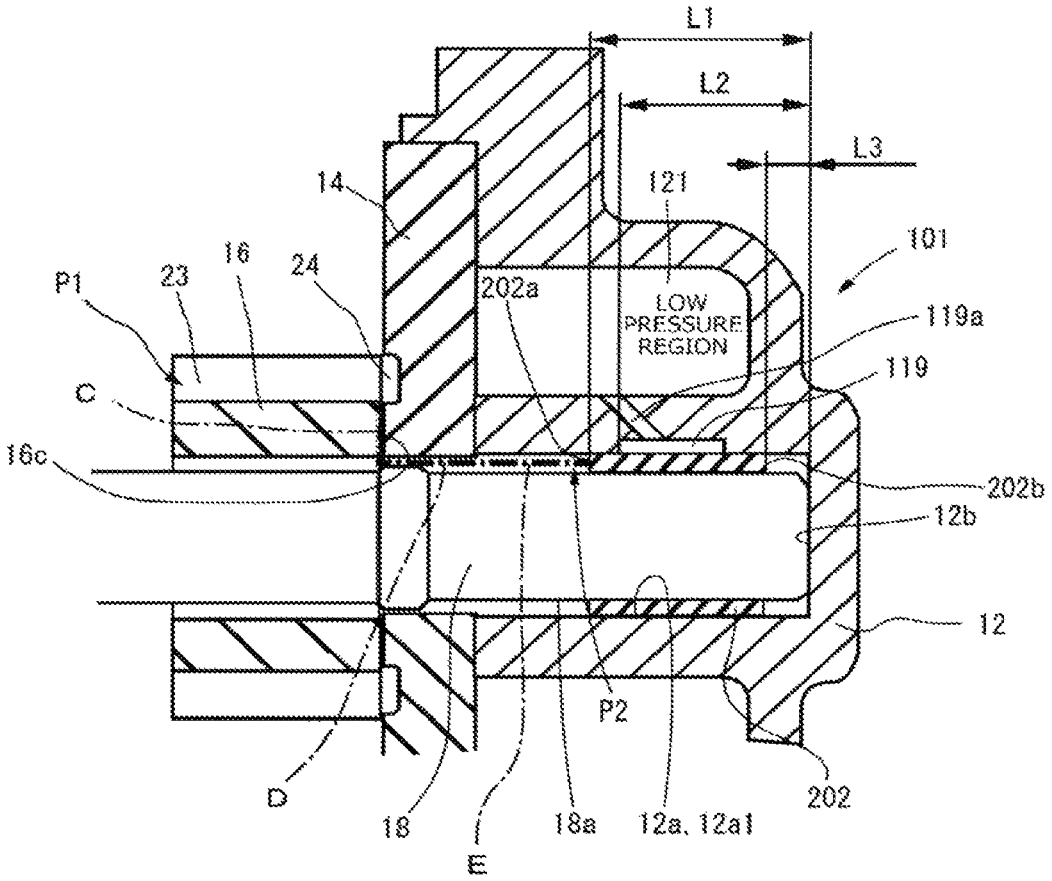
FIG. 9 is a diagram illustrating a second embodiment of the invention.

A second embodiment of the invention will be described below with reference to FIG. 9. In the first embodiment, the pressure relief passage 19 of the pressure relief mechanism RM is in communication with the low pressure region that is an atmospheric pressure space located outside the pump apparatus 1. Specifically, the low pressure region is an inner space of the gearbox casing where the hydraulic oil is stored. The invention, however, is not limited to this embodiment. As illustrated in FIG. 9, a pump apparatus 101 according to the second embodiment includes the suction ports 121 that function as the low pressure region in communication with a pressure relief passage 119 of the pressure relief mechanism RM. In the second embodiment, the pressure relief passage 119 does not pass through the right end of the second housing 12 in FIG. 9. The pressure relief passage 119 is in communication with the suction ports 121 through a communication passage 119*a*. The pump apparatus 101 according to the second embodiment also achieves effects similar to those of the pump apparatus 1 according to the first embodiment.

Each of the pump apparatus 1 according to the first embodiment and the pump apparatus 101 according to the second embodiment is a vane pump. Alternatively, each of the pump apparatuses 1 and 101 may be any other type of pump. In one example, each of the pump apparatuses 1 and 101 may be a known gear pump. In this case, the pressure relief mechanism RM may be disposed between a shaft to rotate a gear and a housing supporting the shaft in a manner similar to that described in the foregoing embodiments. A gear pump usually transfers hydraulic oil by an outer peripheral portion of the gear. The outer peripheral portion of the gear will be referred to as a "hydraulic oil transferring portion". The distance between the hydraulic oil transferring portion and the shaft is long in a radial direction. This reduces the amount and pressure of the hydraulic oil that flows into the pressure relief mechanism RM from the hydraulic oil transferring portion along an end face of the gear. The pump apparatus 1 or 101 that is a gear pump, however, is reasonably cost effective.

The foregoing embodiments have been described on the assumption that each of the pump apparatuses 1 and 101 is an oil pump apparatus for a transmission by way of example only. Each of the pump apparatuses 1 and 101 may be used as an oil pump to supply hydraulic pressure to various hydraulically operated machines, such as a steering system and a machine tool.

What is claimed is:

1. A pump apparatus comprising:

a housing including a suction port and a discharge port;

a shaft rotatably supported in the housing;

a rotator disposed in the housing, the rotator being configured to rotate in accordance with rotation of the shaft so as to transfer hydraulic oil to the discharge port, the hydraulic oil being sucked from the suction port;

a pressure relief passage defined in a portion of the housing facing an outer peripheral surface of the shaft, the pressure relief passage allowing fluid communication of the discharge port with a low pressure region where the hydraulic oil is low in pressure; and a bearing disposed on the outer peripheral surface of the shaft and positioned at least partially in the pressure relief passage and configured for axial movement along the shaft in the pressure relief passage, the bearing supporting the shaft such that the shaft is rotatable relative to the housing, wherein the housing includes a shaft insertion hole, when a pressure of the hydraulic oil in the discharge port is lower than a first predetermined pressure while the shaft is rotating, the bearing does not axially move relative to the housing to keep the pressure relief passage out of communication with an adjacent hydraulic oil passage, and when the pressure of the hydraulic oil in the discharge port has increased to reach or exceed the first predetermined pressure, the hydraulic oil adjacent to a gap between the outer peripheral surface of the shaft and the shaft insertion hole applies a pressure to a first end face of the bearing so that the bearing axially moves relative to the housing until a second end face of the bearing abuts a stopper surface provided in the shaft insertion hole so that the pressure relief passage is in fluid communication with the adjacent hydraulic oil passage.

2. The pump apparatus according to claim 1, wherein the pressure relief passage is defined in a portion of the housing adjacent to an inner peripheral surface of the shaft insertion hole, and the bearing abuts the inner peripheral surface of the shaft insertion hole.

3. The pump apparatus according to claim 1, wherein when the pressure of the hydraulic oil in the discharge port has increased to reach or exceed the first predetermined pressure, the hydraulic oil in the discharge port flows into the pressure relief passage along a lateral surface of the rotator.

4. The pump apparatus according to claim 1, wherein when the pressure of the hydraulic oil in the discharge port has increased to reach or exceed the first predetermined pressure, the bearing axially moves by a distance so as to bring the pressure relief passage into communication with the adjacent hydraulic oil passage, and the distance is set such that the pressure of the hydraulic oil in the discharge port falls between the first predetermined pressure and a second predetermined pressure lower than the first predetermined pressure.

5. The pump apparatus according to claim 1, wherein the low pressure region is an atmospheric pressure space outside the pump apparatus.

6. The pump apparatus according to claim 1, wherein the low pressure region is a space in communication with the suction port in the pump apparatus.

7. The pump apparatus according to claim 1, further comprising a cam ring non-rotatably secured to an inner portion of the housing, the cam ring including an inner peripheral surface defining a cam surface, wherein the rotator includes a rotor rotatably disposed radially inward of the cam ring, the rotor including housing grooves and back pressure chambers, the housing grooves extending radially inward from an outer peripheral surface of the rotor, the back pressure chambers each being defined in a radially inward end of an associated one of the housing grooves, the back pressure chambers being in communication with the discharge port, and vanes each slidably housed in an associated one of the housing grooves, the vanes dividing a circumferential space between the cam surface and the outer peripheral surface of the rotor into pump chambers, and when the pressure of the hydraulic oil in the discharge port has increased to reach or exceed the first predetermined pressure, the bearing axially moves so as to bring the pressure relief passage into communication with the adjacent hydraulic oil passage such that the hydraulic oil stored in the back pressure chambers flows into the pressure relief passage along a lateral surface of the rotor.

8. The pump apparatus according to claim 1, wherein the bearing abuts an inner peripheral surface of the shaft insertion hole.

9. The pump apparatus according to claim 1, wherein the stopper surface is a bottom surface of the shaft insertion hole.

10. The pump apparatus according to claim 1, wherein the stopper surface is a surface of a stopper secured to an outer end face of the shaft insertion hole.

11. The pump apparatus according to claim 1, wherein the bearing is attached to the outer peripheral surface of the shaft.

* * * * *